US008833132B2

(12) United States Patent
Fukano et al.

(10) Patent No.: US 8,833,132 B2
(45) Date of Patent: Sep. 16, 2014

(54) PIPE EXPANDING TOOL

(71) Applicant: SMC Kabushiki Kaisha, Chiyoda-ku (JP)

(72) Inventors: Yoshihiro Fukano, Moriya (JP); Tadashi Uchino, Moriya (JP)

(73) Assignee: SMC Kabushiki Kaisha, Chiyoda-ku (JP)

( * ) Notice: Subject to any disclaimer, the term of this patent is extended or adjusted under 35 U.S.C. 154(b) by 0 days.

(21) Appl. No.: 13/942,867

(22) Filed: Jul. 16, 2013

(65) Prior Publication Data

US 2014/0041434 A1 Feb. 13, 2014

(30) Foreign Application Priority Data

Aug. 9, 2012 (JP) ..... 2012-176891

(51) Int. Cl.
*B21D 9/08* (2006.01)
*B21D 41/00* (2006.01)
*B21D 41/02* (2006.01)

(52) U.S. Cl.
CPC ..... *B21D 41/021* (2013.01)
USPC ..... 72/409.17; 72/392; 29/270

(58) Field of Classification Search
USPC ..... 72/392, 409.16, 409.17; 81/415; 29/235, 246
See application file for complete search history.

(56) References Cited

U.S. PATENT DOCUMENTS

| | | | | | |
|---|---|---|---|---|---|
| 1,093,400 | A | * | 4/1914 | Gottfrid | 294/118 |
| 1,880,172 | A | * | 9/1932 | Bergman et al. | 29/246 |
| 2,334,781 | A | * | 11/1943 | Maines | 81/302 |
| 2,769,358 | A | * | 11/1956 | Hill | 72/392 |
| 2,784,623 | A | * | 3/1957 | Reynolds | 72/392 |
| 3,171,676 | A | * | 3/1965 | Horn | 285/222 |
| 3,233,313 | A | * | 2/1966 | Roth | 29/235 |
| 4,602,496 | A | * | 7/1986 | Wagener | 72/409.17 |
| 4,934,171 | A | * | 6/1990 | Konetzke, Jr. | 72/409.16 |
| 5,382,151 | A | | 1/1995 | Hayes, Jr. et al. | |
| 2009/0007734 | A1 | * | 1/2009 | Lulewicz et al. | 81/415 |

FOREIGN PATENT DOCUMENTS

| | | | |
|---|---|---|---|
| JP | 7-88780 | A | 4/1995 |
| JP | 10-264051 | A | 10/1998 |

* cited by examiner

*Primary Examiner* — David B Jones
(74) *Attorney, Agent, or Firm* — Oblon, Spivak, McClelland, Maier & Neustadt, L.L.P.

(57) ABSTRACT

A pipe expanding tool includes levers rotatably connected to each other through a rotary shaft, grips disposed on ends of the levers, jaws disposed on other ends of the levers, and mandrels disposed on the jaws. An adjustment screw for adjusting an angle of rotation of the levers, a lock nut for fixing the adjustment screw, and a stopper that restricts rotation of the levers are further provided.

4 Claims, 10 Drawing Sheets

PIPE EXPANDING TOOL

CROSS-REFERENCE TO RELATED APPLICATION

This application is based upon and claims the benefit of priority from Japanese Patent Application No. 2012-176891 filed on Aug. 9, 2012, the contents of which are incorporated herein by reference.

BACKGROUND OF THE INVENTION

1. Field of the Invention

The present invention relates to a pipe expanding tool for expanding an end of a tube, for example, a tube for introduction and discharge of a fluid.

2. Description of the Related Art

Heretofore, a pipe expanding tool has been known for expanding an end of a tube made from a synthetic resin, the pipe expanding tool serving as a mounting jig, which is used when the tube is connected to a pipe joint.

For example, as disclosed in U.S. Pat. No. 5,382,151, such a pipe expanding tool 1 is constituted from a pair of levers 3, 4, which are connected rotatably via a rotary shaft 2. A pair of grips 5, 6 is provided on one of the ends of the pair of levers 3, 4, whereas a pair of plate-shaped jaws 7, 8 is provided on the other ends thereof. A pair of semicircular truncated conical mandrels 9, 10 is provided on lower surfaces of the pair of jaws 7, 8 (see FIG. 8).

As shown in FIG. 8, the pair of mandrels 9, 10 is constructed such that, when the jaws 7, 8 are closed, the two semicircular truncated conical mandrels 9, 10 abut mutually with each other to form a circular truncated cone.

Thus, when the pipe expanding tool 1 is used to expand an end of a tube 11, as shown in FIG. 9, first, in a state in which the jaws 7, 8 are closed, the circular truncated cone formed by the mandrels 9, 10 is inserted into an open end of the tube 11. Next, when the grips 5, 6 are displaced in directions to approach one another, as shown in FIG. 10, the levers 3, 4 are rotated about the rotary shaft 2, and the jaws 7, 8 are expanded. Accompanying expansion of the jaws 7, 8, the mandrels 9, 10 separate away from each other, and the circumferential side surfaces of the mandrels 9, 10 are pressed outwardly against the inner circumferential surface of the end of the tube 11, whereby the end of the tube 11 is expanded.

Furthermore, when the grips 5, 6 are displaced in directions to approach one another, the levers 3, 4 rotate further, and inside end surfaces 12, 13 of the levers 3, 4 abut mutually against each other. Rotational movement of the levers 3, 4 is restricted by the inside end surfaces 12, 13, and rotation thereof is stopped. The expanding motion of the jaws 7, 8 is brought to an end accompanying the stop in rotation of the levers 3, 4. At this time, the circumferential side surfaces of the mandrels 9, 10, which have pressed the end of the tube 11 outwardly from the inner side thereof, arrive at displacement end positions, whereupon the pipe expanding operation with respect to the end of the tube 11 is completed. Thus, by utilizing the pipe expanding tool 1 in the above sequence of steps, the end of the tube can be expanded.

SUMMARY OF THE INVENTION

Incidentally, in the pipe expanding tool 1 disclosed in the specification of U.S. Pat. No. 5,382,151, in the case that the inside end surfaces 12, 13 of the levers 3, 4 abut against one another, the inner diameter of the end of the tube 11 cannot be expanded any further. This is because the inside end surfaces 12 and 13 act to restrict further rotation of the levers 3, 4.

Stated otherwise, in the pipe expanding tool 1, after the pipe expanding process has been performed, the inner diameter of the tube 11 is predetermined by the size of the angle $\alpha$ that is formed by the inside end surfaces 12, 13, i.e., the size of the angle of rotation $\alpha$ by which the levers 3, 4 can be rotated. Consequently, when the ends of the tubes 11 are expanded using the pipe expanding tool 1, it is necessary to prepare a plurality of pipe expanding tools having different sizes for the angle $\alpha$ for respective desired inner diameters of the tubes 11. For this reason, operations are made more complex and processing costs tend to increase.

Of course, when the end of the tube 11 is expanded using the pipe expanding tool 1, it is possible to adjust the extent to which the inner diameter of the tube 11 is expanded after expansion thereof by manually stopping displacement of the grips 5, 6 before the inside end surfaces 12, 13 come into abutment with each other. However, in this case, it is easy for differences in operation of the grips 5, 6 to occur depending on the ways in which different operators may use the pipe expanding tool 1, and there is a concern that variances will occur in the inner diameters of a plurality of tubes 11 that are intended to be expanded at the same diameter.

The present invention has been devised taking into consideration the aforementioned problems, and has the object of providing a pipe expanding tool in which, with a single pipe expanding tool, it is possible to expand tubes to desired inner diameters, while at the same time enabling a predetermined inner diameter for the tubes to be set easily and reliably.

To achieve the aforementioned object, the present invention is characterized by a pipe expanding tool comprising first and second levers rotatably connected to each other through a rotary shaft, a pair of grips disposed on ends of the first and second levers, a pair of jaws disposed on other ends of the first and second levers, a pair of mandrels disposed on the pair of jaws, wherein the mandrels are capable of being inserted into an open end of a tube to be expanded, and adjustment means disposed on at least one of the first and second levers for adjusting an angle of rotation of the first and second levers.

According to the present invention, since the angle of rotation of the first and second levers can be adjusted beforehand to an angle that corresponds to a desired inner diameter of the tube, it is possible, using a single pipe expanding tool, to expand the tube to a desired inner diameter.

Further, the adjustment means may comprise an adjustment screw disposed on a side surface of at least one of the first and second levers.

In accordance with the above structure, by a simple operation of rotating the adjustment screw, the angle of rotation of the first and second levers can easily be set beforehand to an angle that corresponds to a desired inner diameter of the tube.

Further, the adjustment means may further comprise a lock nut for fixing rotation of the adjustment screw.

According to the above structure, since the adjustment screw can be fixed in place by the lock nut, the angle of rotation of the first and second levers can reliably be set beforehand to an angle that corresponds to a desired inner diameter of the tube.

Further, preferably the adjustment means may further comprise a stopper, which is provided on a side surface of another of the first and second levers, such that rotation of the first and second levers is restricted by abutment of the adjustment screw against the stopper.

According to the above structure, upon abutment of the adjustment screw against the stopper, since rotation of the first and second levers is restricted, the first and second levers can be prevented from being rotated in excess of the preset angle of rotation.

Still further, the pair of mandrels may be fixed detachably with respect to the jaws by a pair of screws.

According to the above structure, prior to the pipe expansion process, the mandrels can be replaced by mandrels having suitable radii for each of the inner diameters of the tubes, such as mandrels that form a diameter slightly smaller than the inner diameter of the unexpanded tube. Thus, it is unnecessary to prepare a plurality of the pipe expanding tools equipped with mandrels having different radii for each of the inner diameters of the unexpanded tubes.

Further, an elastic member may be disposed between the first and second levers.

According to the above structure, after the first lever and the second lever have been displaced, by means of the elastic force of the elastic member, the first lever and the second lever can easily be restored to an original position.

In accordance with the present invention, the following advantageous effects are obtained.

When an open end of a tube made of synthetic resin or the like is to be expanded, with a single pipe expanding tool, the tube can be expanded to a desired inner diameter, while at the same time, by setting a desired inner diameter for the tube beforehand, the tube can be expanded easily and reliably to the desired inner diameter.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

A preferred embodiment of a pipe expanding tool according to the present invention will be described in detail below with reference to the accompanying drawings.

Figure 1:
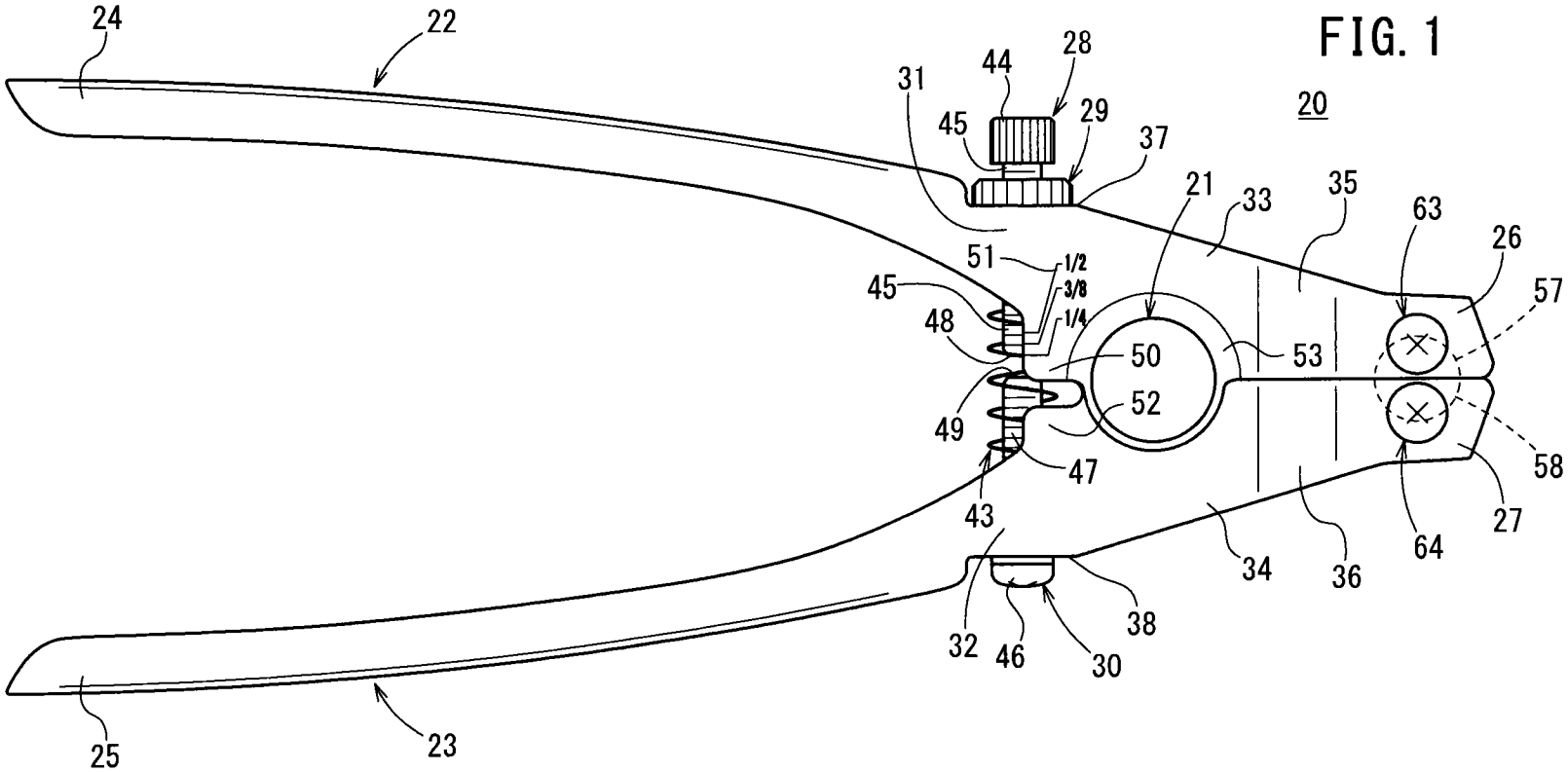
FIG. 1 is an overall front view of a pipe expanding tool according to an embodiment of the present invention.
Figure 2:
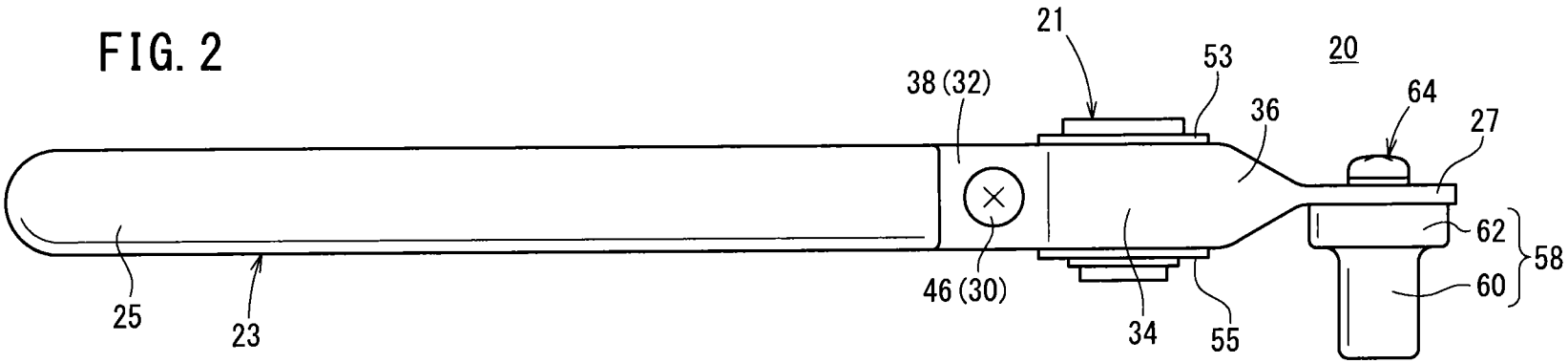
FIG. 2 is an overall side view of the pipe expanding tool shown in FIG. 1.

In FIG. 1, reference numeral 20 indicates a pipe expanding tool according to an embodiment of the present invention. As shown in FIGS. 1 through 4, the pipe expanding tool 20 is made up from a rotary shaft 21, and first and second levers 22, 23, which are connected together rotatably via the rotary shaft 21.

The first and second levers 22, 23 are formed from a metal material, for example. Grips 24, 25 for being gripped by an operator are provided on ends of the first and second levers 22, 23, whereas flat-plate-shaped jaws 26, 27 for implementing a pipe-expanding action on an end of a tube are provided on other ends of the first and second levers 22, 23. Between the grips 24, 25 and the jaws 26, 27, seating sections 31, 32 are provided, which are connected to the grips 24, 25, and on which there are mounted an adjustment screw 28, a lock nut 29, and a stopper 30. Continuous with the seating sections 31, 32, connecting members 33, 34 are provided through which the rotary shaft 21 is inserted, and to which the first and second levers 22, 23 are connected. Following the connecting members 33, 34, stepped portions 35, 36 extend therefrom that connect the connecting members 33, 34 with the jaws 26, 27 (see FIG. 1).

The grips 24, 25 of the first and second levers 22, 23 are substantially U-shaped in cross section. The grips 24, 25 are disposed such that open portions, which correspond to upper U-shaped parts thereof, confront one another, i.e., face respectively toward the inside. Accordingly, curved surfaces corresponding to the lower U-shaped parts are arranged so as to curve in convex shapes toward the outside.

As shown in FIG. 1, at times of non-operation, the grips 24, 25 are arranged substantially in parallel with each other, extending in a slightly curved manner toward the inside, so as to approach one another in a direction toward the rotary shaft 21. Further, the grips 24, 25 are continuous with the seating sections 31, 32, to which there are attached the adjustment screw 28, the lock nut 29, and the stopper 30.

The seating sections 31, 32 are substantially squared U-shaped in cross section, and similar to the grips 24, 25, are disposed such that open portions thereof confront one another, i.e., so as to face mutually toward the inside. In the seating sections 31, 32, surfaces thereof confronting the open portions are formed in planar shapes, and function as seating surfaces 37, 38 to which the adjustment screw 28, the lock nut 29 and the stopper 30 are attached.

Figure 3:
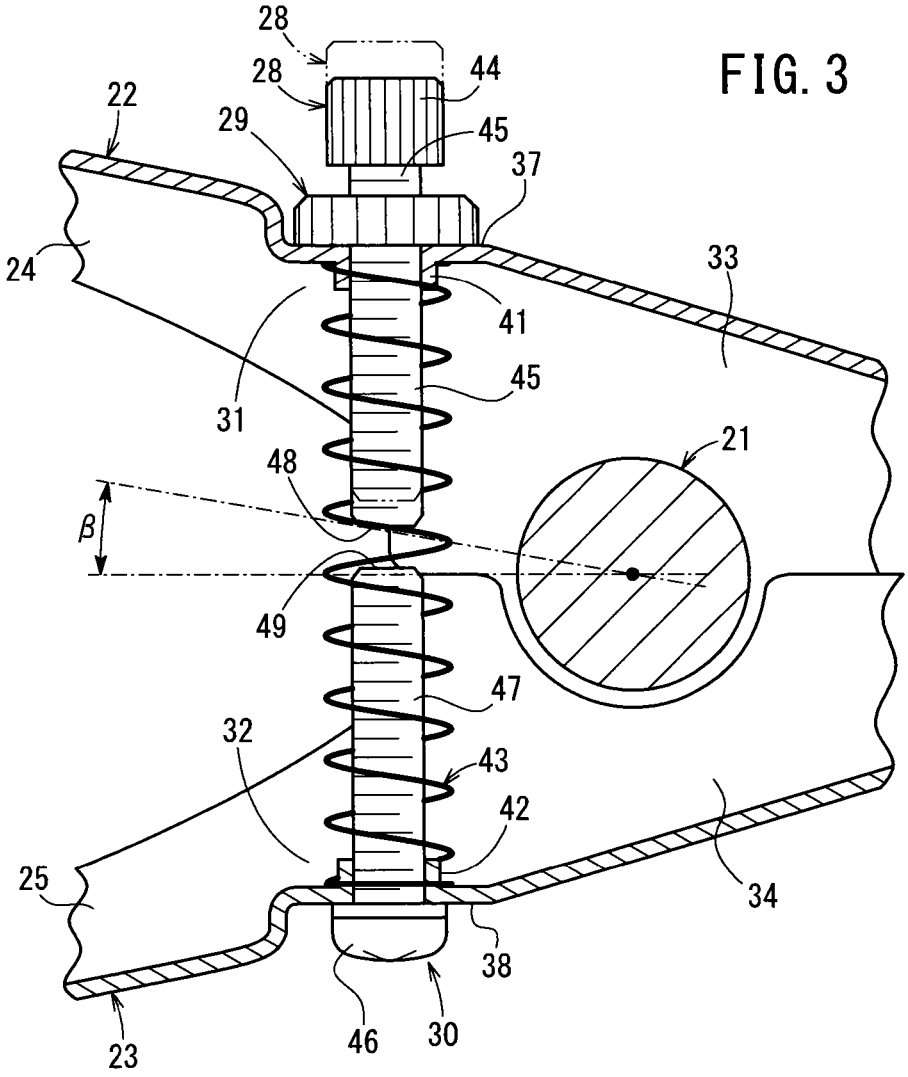
FIG. 3 is an enlarged cross sectional view of an adjustment screw and a stopper of the pipe expanding tool of FIG. 1.

As shown in FIG. 3, cylindrical projections 41, 42, which are directed mutually inward, are formed in a protruding manner on the seating surfaces 37, 38. Inner circumferential surfaces of the projections 41, 42 are engraved with non-illustrated screw threads.

A coil spring (elastic member) 43 is wound over outer circumferential surfaces of the projections 41, 42. The coil spring 43 is suspended between the first lever 22 and the second lever 23, such that one end thereof is seated in an outwardly fitted manner on the projection 41 of the first lever 22, whereas the other end thereof is seated in an outwardly fitted manner on the projection 42 of the second lever 23.

The adjustment screw 28 is formed from a head portion 44 on which a knurling process is implemented, and a shaft portion 45 engraved with male threads thereon. In the present embodiment, the length of the shaft portion 45 is slightly greater than a length obtained by adding the height of the lock nut 29 to half the length of the distance between the seating surface 37 and the seating surface 38.

The shaft portion 45 of the adjustment screw 28, after having been inserted through the lock nut 29, is screw-inserted into the interior of the projection 41 via non-illustrated threads, which are engraved on the inner circumferential surface of the projection 41 of the seating surface 37. The depth at which the shaft portion 45 is screw-inserted can be adjusted by turning the head portion 44. Following screw-insertion of the shaft portion 45 to a desired depth, the lock nut 29 is rotated in a direction to approach the seating surface 37 and is tightened, whereupon the adjustment screw 28 is fixed with respect to the seating section 31 of the first lever 22. More specifically, the lock nut 29 functions as a fixing means for reliably fixing the position of a distal end 48 of the shaft portion 45 of the adjustment screw 28.

On the other hand, the stopper 30 is constituted from a flat shaped head portion 46 with the edge on an upper surface thereof being rounded, the head portion 46 having a cross-shaped hole, and a shaft portion 47 engraved with male threads thereon. The length of the shaft portion 47 is slightly greater than half the length of the distance between the seating surface 37 and the seating surface 38.

The shaft portion 47 of the stopper 30 is screw-inserted in the interior of the projection 42, which projects inwardly from the seating surface 38. More specifically, the male threads of the shaft portion 47 are screw-engaged with non-illustrated screw threads provided on the inner circumferential surface of the projection 42, and by turning the head portion 46, the shaft portion 47 is screw-inserted toward the inside of the seating surface 38. In addition, after screw-insertion of the entire shaft portion 47 into the interior of the projection 42, the head portion 46 is tightened firmly, whereby the stopper 30 is fixed on the seating section 32 of the second lever 23.

In this manner, the adjustment screw 28 is disposed in such a manner that the adjustment screw 28 is capable of being advanced and retracted with respect to the first lever 22, whereas the stopper 30 is fixed in place with respect to the second lever 23. Accordingly, by rotating the head portion 44 of the adjustment screw 28, an operator can adjust the relative distance between the distal end 48 of the shaft portion 45 of the adjustment screw 28 and a distal end 49 of the shaft portion 47 of the stopper 30.

As noted previously, the seating sections 31, 32 are squared U-shaped in cross section, such that openings thereof are arranged in confronting relation, or more specifically, facing respectively toward the inside.

The seating section 31 of the first lever 22 extends toward the second lever 23 in partial covering relation to the coil spring 43 and the adjustment screw 28, and a distal end 50 of the seating section 31 reaches to a center point between the seating surface 37 and the seating surface 38. Three scale markings 51 separated mutually by given distances are provided on the front surface of the seating section 31.

As shown in FIG. 1, at ends of the scale markings 51, numerical values are engraved such as, for example, "½", "⅜", and "¼" to indicate fractions of inches. The numerical values represent the size of the inner diameter of the tube on which an expansion process can be performed using the pipe expanding tool 20. The units of length are indicated in inches as an example, although other units, such as millimeter units or the like, may also be provided. Further, the number of scale markings 51 is not limited to three.

On the other hand, the other ends of the scale markings 51 are intended to indicate the position of the distal end 48 of the shaft portion 45 of the adjustment screw 28, which corresponds to the inner diameter of the tube. Accordingly, by an operator confirming the scale markings 51 and the numerical values, which indicate the inner diameter of the tube, the position of the distal end 48 of the shaft portion 45 of the adjustment screw 28 can easily be set appropriately for the inner diameter of the tube, which is the object to be subjected to the pipe expansion process. For adjusting the position of the distal end 48 of the shaft portion 45 of the adjustment screw 28, after the lock nut 29 has been released from a tightened state, the adjustment screw 28 may be advanced and retracted by turning the head portion 44 of the adjustment screw 28.

Further, the seating section 32 of the second lever 23 extends toward the first lever 22 in partial covering relation to the coil spring 43 and the stopper 30, and a distal end 52 of the seating section 32 reaches just short of the center point between the seating surface 37 and the seating surface 38.

More specifically, the distal end 50 on the seating section 31 of the first lever 22, and the distal end 52 on the seating section 32 of the second lever 23 are positioned to be separated from each other. Therefore, for example, when a force is applied to the grips 24, 25 of the first and second levers 22, 23 to thereby displace the grips 24, 25 in directions to approach one another, the first and second levers 22, 23 are rotated about the rotary shaft 21, and the distal end 50 and the distal end 52 are brought closer together. Because the distal end 50 and the distal end 52 are positioned in such a mutually separated fashion, both the ends coming into abutment and restricting rotation of the first and second levers 22, 23 can be avoided. Further, even if an excessive force is applied to the grips 24, 25 of the first and second levers 22, 23, such that the first and second levers 22, 23 are attempted to be rotated about the rotary shaft 21 in excess of the desired range of rotation, the distal end 50 and the distal end 52 come into abutment, such rotation is restricted, and excessive rotation can be suppressed.

As shown in FIG. 1, in the first and second levers 22, 23, the connecting members 33, 34 through which the rotary shaft 21 is inserted are formed so as to extend from the seating sections 31, 32 on which the adjustment screw 28 and the stopper 30 are seated, in a direction (direction to the right in FIG. 1) from the grips 24, 25 toward the seating sections 31, 32.

The connecting members 33, 34 are squared U-shaped in cross section, such that openings thereof are arranged in confronting relation, or more specifically, facing respectively toward the inside. Rotary shaft attachment hole portions 53, 54, 55, 56, in which there are formed non-illustrated rotary shaft attachment holes, are formed on the connecting members 33, 34.

Figure 4:
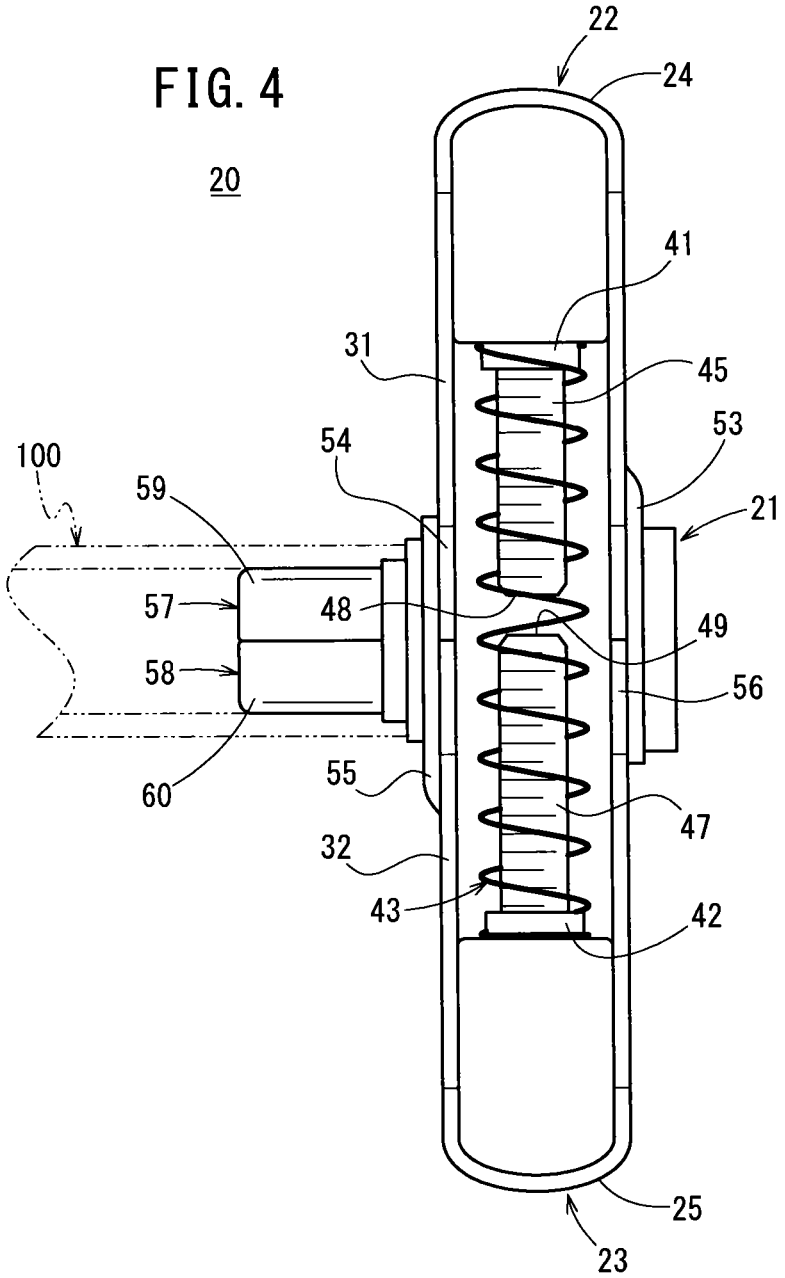
FIG. 4 is an overall side view showing a condition in which mandrels are inserted into a tube, in the pipe expanding tool of FIG. 1.

As shown in FIG. 4, one of the rotary shaft attachment hole portions 53 of the first lever 22 is formed to jut outwardly (in the right-hand direction of FIG. 4), whereas the other rotary shaft attachment hole portion 54 is formed substantially coplanar with the grips 24, 25 and the seating sections 31, 32. Similarly, one of the rotary shaft attachment hole portions 55 of the second lever 23 is formed to jut outwardly (in the left-hand direction of FIG. 4), whereas the other rotary shaft attachment hole portion 56 is formed substantially coplanar with the grips 24, 25 and the seating sections 31, 32.

In addition, the other rotary shaft attachment hole portion 56 of the second lever 23 is inserted into the inside of the one rotary shaft attachment hole portion 53 of the first lever 22, and the other rotary shaft attachment hole portion 54 of the first lever 22 is inserted into the inside of the one rotary shaft attachment hole portion 55 of the second lever 23.

Accordingly, the one rotary shaft attachment hole portion 53 of the first lever 22 and the other rotary shaft attachment hole portion 56 of the second lever 23 are stacked alternately, and the non-illustrated rotary shaft attachment holes provided on both the portions are arranged coaxially. Similarly, the one rotary shaft attachment hole portion 55 of the second lever 23 and the other rotary shaft attachment hole portion 54 of the first lever 22 are stacked alternately, and the non-illustrated rotary shaft attachment holes provided on both the portions are arranged coaxially.

The rotary shaft 21 is inserted and affixed with respect to the non-illustrated rotary shaft attachment holes, which have been arranged in the foregoing manner, for example, by deforming ends of the rotary shaft 21, whereby the first and second levers 22, 23 are connected rotatably about the rotary shaft 21.

As shown in FIG. 1, on the first and second levers 22, 23, the stepped portions 35, 36 are formed so as to extend from the connecting members 33, 34 through which the rotary shaft 21 is inserted, in a direction (direction to the right in FIG. 1) from the seating sections 31, 32 toward the connecting members 33, 34.

The stepped portions 35, 36 are squared U-shaped in cross section continuing from the connecting members 33, 34, and are disposed such that open distal end portions thereof, which are squared U-shaped in cross section, approach mutually toward each other in a direction (direction to the right in FIG. 1) from the seating sections 31, 32 toward the connecting members 33, 34. Ultimately, both the portions abut against each other in a planar shape, whereby the ends of the first and second levers 22, 23 form a pair of jaws 26, 27.

A pair of mandrels 57, 58 are provided respectively on lower surfaces of the jaws 26, 27 so as to project from the lower surfaces. The mandrels 57, 58 are fixed detachably with respect to the jaws 26, 27 by a pair of screws 63, 64, which are screw-inserted therein from upper surfaces of the jaws 26, 27.

Each of mandrels 57, 58 is formed in a substantially semicircular columnar shape, which is obtained by longitudinally halving a cylinder. Surfaces thereof, which correspond to divided surfaces of the cylinder, confront one another mutually, and in a state in which the jaws 26, 27 are closed, the surfaces corresponding to the divided surfaces of the cylinder abut against each other to thereby form a single cylindrical shape.

More specifically, the pair of mandrels 57, 58 are made up from a pair of diameter expanding parts 59, 60, which exhibit a cylindrical columnar shape in a state in which the jaws 26, 27 are closed, and a pair of ring-shaped base members 61, 62, which project in radial directions outwardly from the diameter expanding parts 59, 60. The base members 61, 62 are disposed between the diameter expanding parts 59, 60 and the jaws 26, 27. The diameter expanding parts 59, 60 and the base members 61, 62 are disposed in an integral manner.

Further, in top portions of the diameter expanding parts 59, 60, edge lines of the top portions that correspond to the arcs of the semicircular shapes of top surfaces of the diameter expanding parts 59, 60 are rounded.

The pipe expanding tool 20 according to the present embodiment is constructed basically as described above. Next, effects and advantages of the pipe expanding tool 20 will be described.

As shown in FIG. 4, a state in which the jaws 26, 27 are closed, and in which the two mandrels 57, 58 are in mutual abutment, will be described as an initial condition. At this time, a load is not imposed with respect to the coil spring 43 and the coil spring 43 is in an expanded state.

In order to expand the end of a tube 100 using the pipe expanding tool 20, at first, an operator confirms the inner diameter size after expansion of the end of the tube 100, which is needed in order to connect the tube 100 to a pipe joint. In addition, while referring to the scale markings 51 provided on the connecting member 33 of the first lever 22, the operator rotates the head portion 44 of the adjustment screw 28, whereby the distal end 48 of the shaft portion 45 of the adjustment screw 28 is moved to a position indicative of a desired inner diameter size, as shown by the scale markings 51. Then, by tightening the lock nut 29, the position of the distal end 48 of the shaft portion 45 of the adjustment screw 28 is fixed securely.

Next, the pair of mandrels 57, 58, which have substantially semicylindrical columnar shapes, are inserted into the open end of a tube 100 on which a pipe expansion process is to be performed. At this time, preferably, the end of the tube 100 is inserted over the mandrels 57, 58 until the tube 100 comes into abutment against the base members 61, 62.

Figure 5:
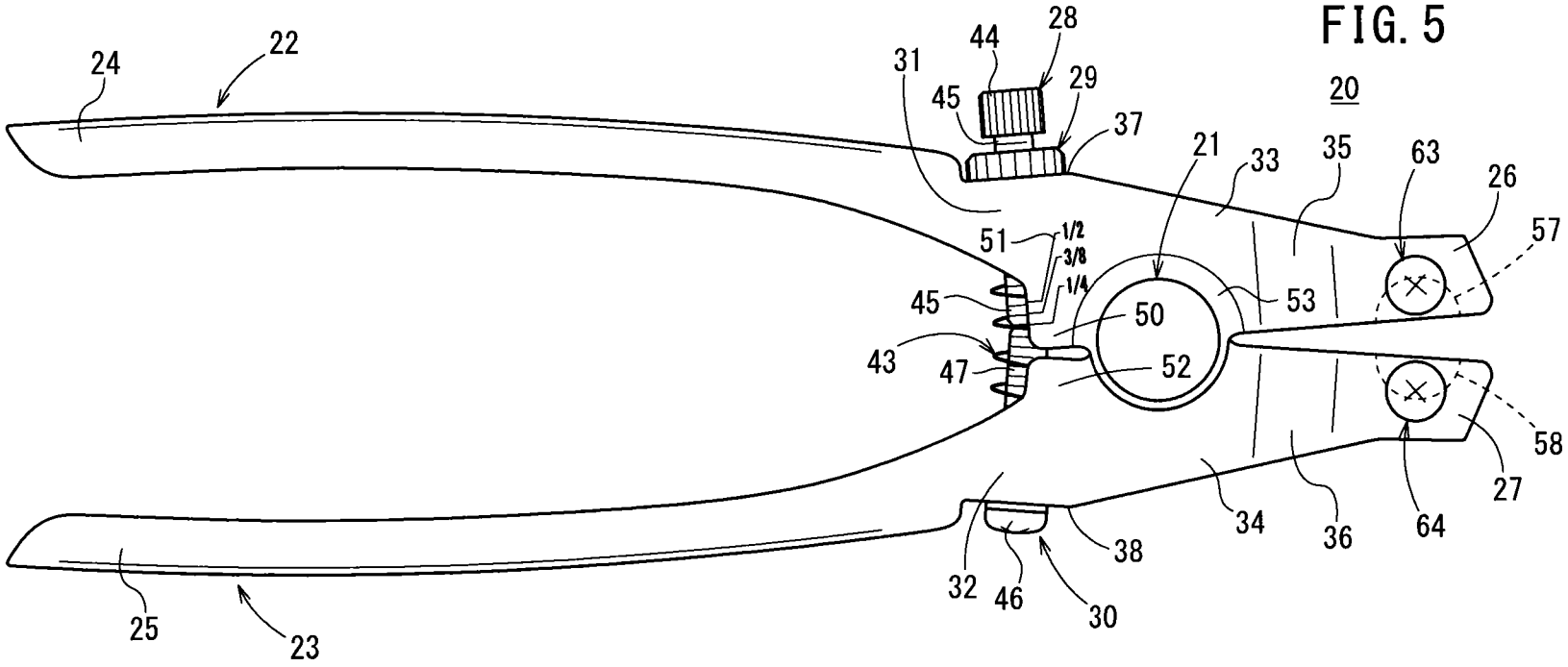
FIG. 5 is an overall front view of the pipe expanding tool according to the embodiment of the present invention, showing a state in which jaws thereof are expanded.
Figure 7:
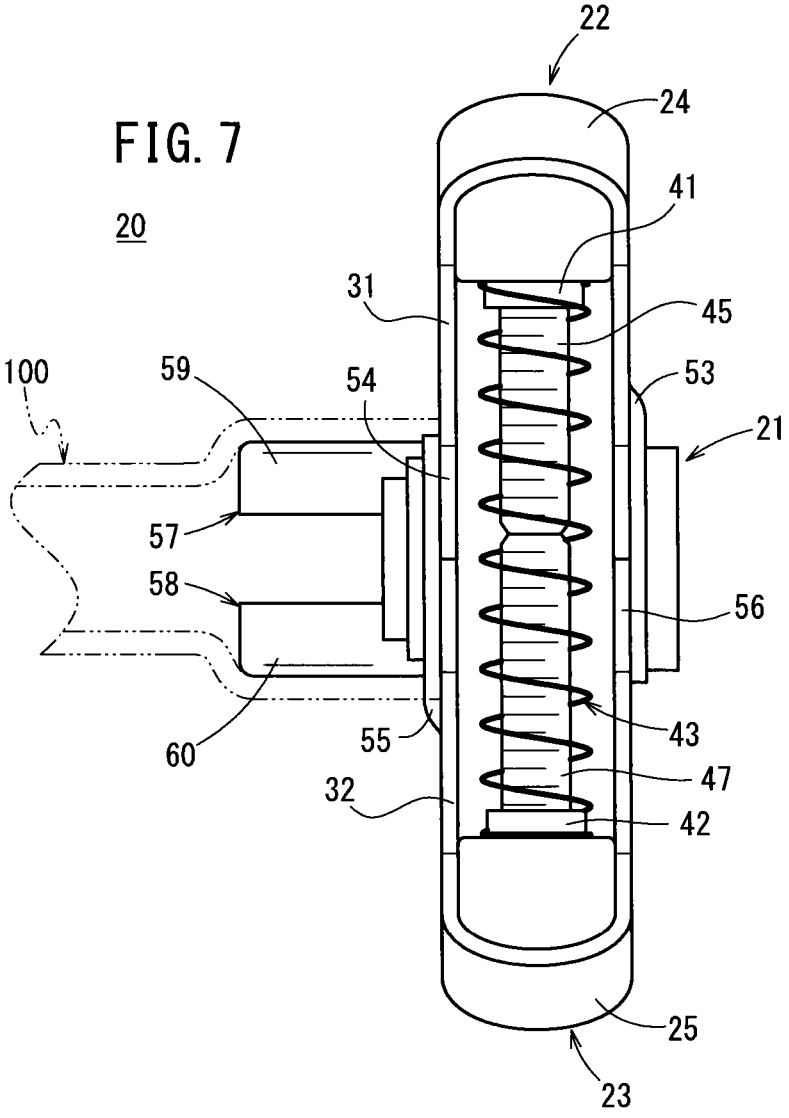
FIG. 7 is an overall side view showing a condition in which mandrels are inserted into a tube, in the pipe expanding tool of FIG. 5.
Figure 8:
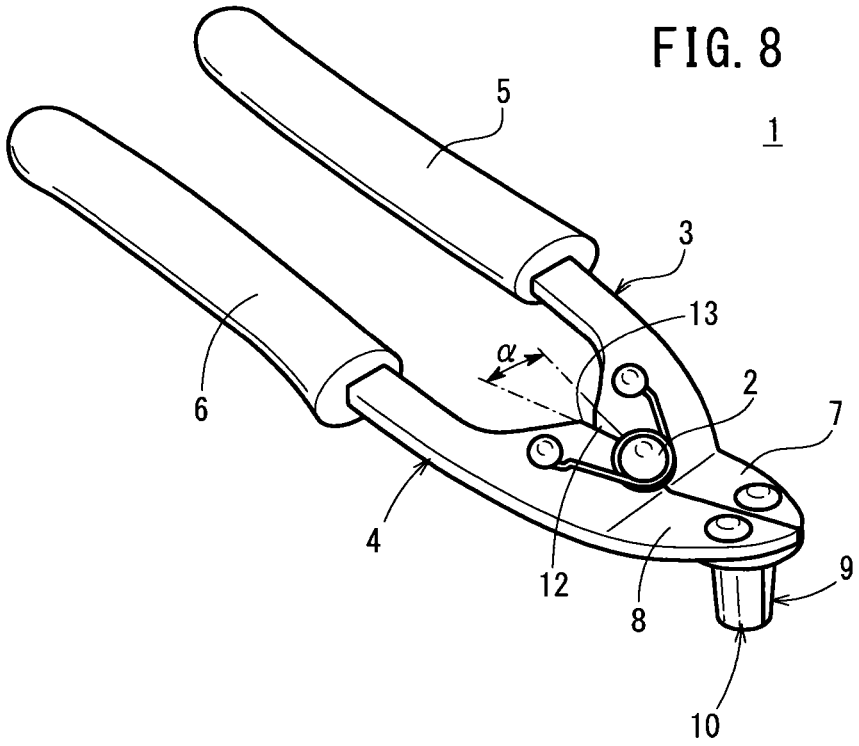
PRIOR ART FIG. 8
FIG. 8 is an overall perspective view of a pipe expanding tool according to the related art.
Figure 9:
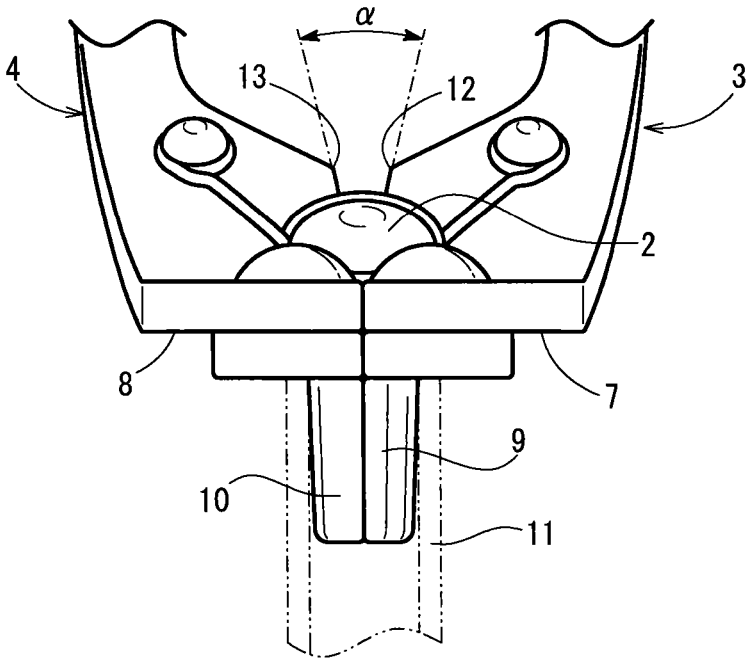
PRIOR ART FIG. 9
FIG. 9 is a partially enlarged view showing a condition in which mandrels are inserted into a tube, in the pipe expanding tool shown in FIG. 8.
Figure 10:
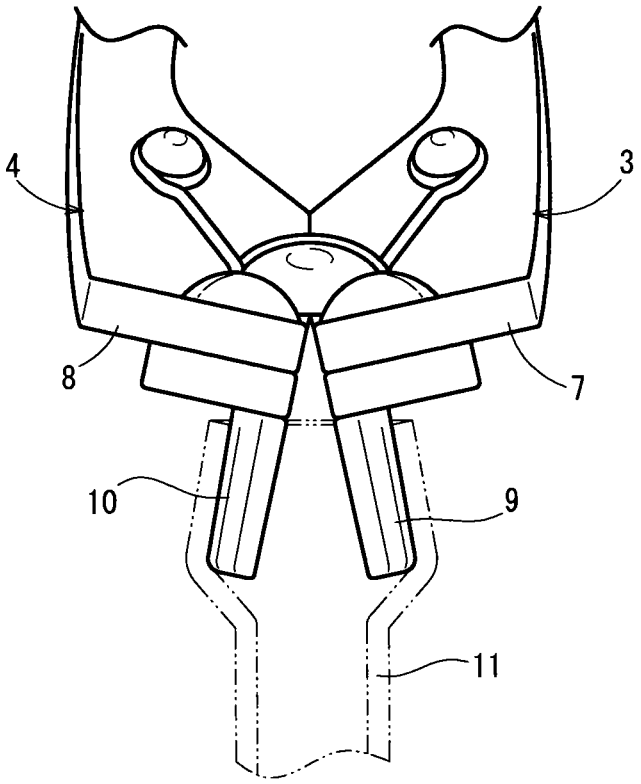
PRIOR ART FIG. 10
FIG. 10 is a partially enlarged view of the pipe expanding tool shown in FIG. 8, showing a state in which the jaws thereof are expanded.

In addition, when the grips 24, 25 are gripped and displaced in directions to approach one another, as shown in FIG. 5, accompanying displacement of the grips 24, 25, the first and second levers 22, 23 rotate about the rotary shaft 21, and the jaws 26, 27 expand, together with the substantially semicylindrical shaped mandrels 57, 58, which are attached to the jaws 26, 27, being displaced in directions to separate away from each other. As shown in FIG. 7, accompanying displacement of the mandrels 57, 58, the circumferential side surfaces of the mandrels 57, 58 press the inner circumferential surface of the end of the tube 100 from the inside toward the outside, whereupon the end of the tube 100 is expanded.

Further, accompanying displacement of the grips 24, 25, the relative distance between the distal end 48 of the adjustment screw 28, which is provided on the first lever 22, and the distal end 49 of the stopper 30, which is provided on the second lever 23, becomes shorter. Simultaneously, the coil spring 43 is compressed and elastic energy is stored in the coil spring 43.

Figure 6:
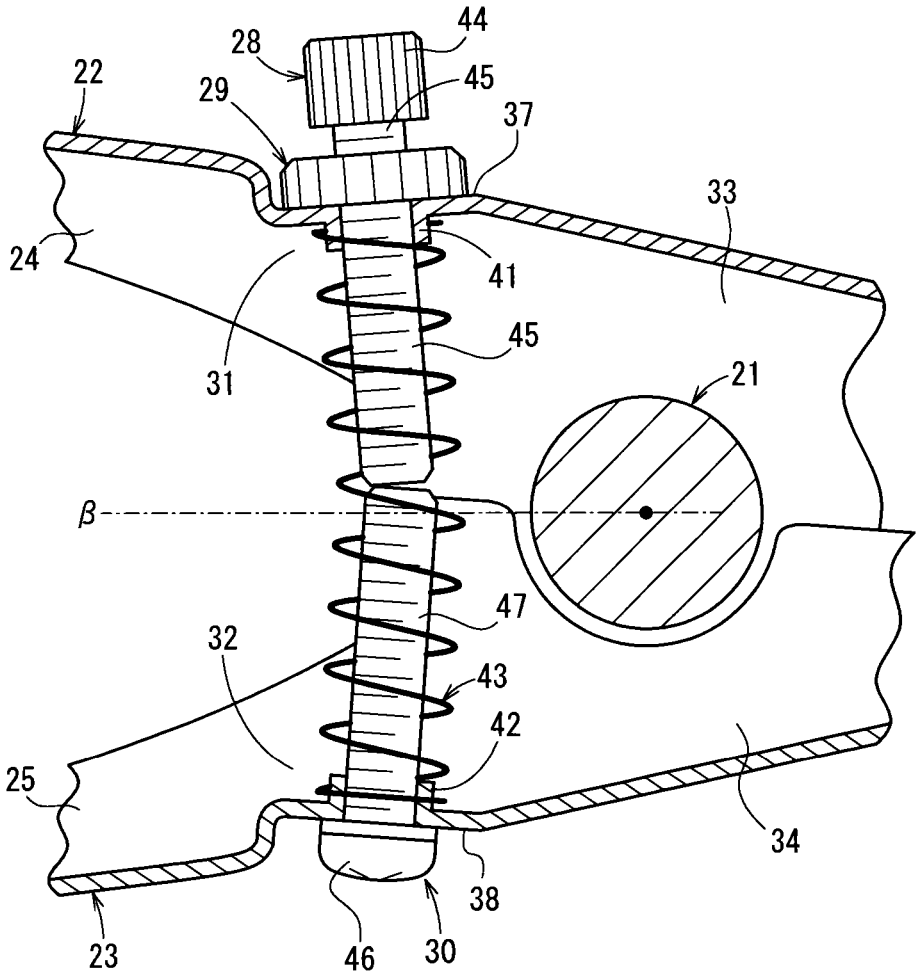
FIG. 6 is an enlarged cross sectional view of an adjustment screw and a stopper of the pipe expanding tool of FIG. 5.

Furthermore, when the grips 24, 25 are displaced to approach one another, accompanying displacement of the grips 24, 25, the first and second levers 22, 23 rotate about the rotary shaft 21, and as shown in FIGS. 6 and 7, the distal end 48 of the adjustment screw 28 and the distal end 49 of the stopper 30 come into abutment. After the distal end 48 of the adjustment screw 28 and the distal end 49 of the stopper 30 abut against each other, rotation of the first and second levers 22, 23 is stopped.

At this time, the expansion operation of the jaws 26, 27 is completed, the circumferential side surfaces of the mandrels 57, 58 reach their respective displacement end positions, and the pipe expanding process on the tube 100 is brought to an end. Therefore, the circumferential side surfaces of the mandrels 57, 58 do not perform any additional pipe expansion on the inner circumferential surface of the end of the tube 100, and in such stopped positions, the mandrels 57, 58 maintain the inner diameter of the tube 100 after expansion thereof.

In addition, when the force applied with respect to the grips 24, 25 is released, under an action of the elastic force of the coil spring 43, the first and second levers 22, 23 are restored to the initial position. Accordingly, the grips 24, 25 can be restored to the initial position merely by the operator releasing the force applied to the grips 24, 25.

Thereafter, when the mandrels 57, 58 are taken out from the end of the tube 100, a pipe-expanded tube 100, the end of which has been expanded, can be obtained.

Next, a case will be described in which an end of a tube 100 is expanded to a desired inner diameter using the pipe expanding tool 20. For this case, an initial condition will be described in which, from among the scale markings 51, the distal end 48 of the adjustment screw 28 is currently arranged at the position indicated by the line representing ⅜ of an inch.

For example, for expanding the inner diameter of the end of the tube 100 to a size of ½ of an inch, which is greater than ⅜ of an inch, by rotating the head portion 44 of the adjustment screw 28, the distal end 48 of the adjustment screw 28 is moved to the position indicated by the line representing ½ of an inch from among the scale markings 51. As a result, compared to the initial condition, the relative distance between the distal end 48 of the adjustment screw 28 and the distal end 49 of the stopper 30 is increased.

More specifically, the relative distance between the distal end 48 of the adjustment screw 28 and the distal end 49 of the stopper 30 is increased, whereby the angle of rotation β through which the first and second levers 22, 23 can be rotated becomes greater compared to the initial condition. Owing thereto, the jaws 26, 27 are operated to expand to a greater extent, and the circumferential side surfaces of the mandrels 57, 58 also are displaced by larger distances. Thus, the pipe expanding tool 20 is made capable of expanding the end of the tube 100 to an inner diameter of ½ of an inch, which is greater than ⅜ of an inch.

For example, for expanding the inner diameter of the end of the tube 100 to a size of ¼ of an inch, which is smaller than ⅜ of an inch, by rotating the head portion 44 of the adjustment screw 28, the distal end 48 of the adjustment screw 28 is moved to the position indicated by the line representing ¼ of an inch from among the scale markings 51. As a result, compared to the initial condition, the relative distance between the distal end 48 of the adjustment screw 28 and the distal end 49 of the stopper 30 is made shorter.

More specifically, the relative distance between the distal end 48 of the adjustment screw 28 and the distal end 49 of the stopper 30 is made shorter, whereby the angle of rotation β through which the first and second levers 22, 23 can be rotated becomes smaller compared to the initial condition. Owing thereto, the jaws 26, 27 are operated to expand to a lesser extent, and the circumferential side surfaces of the mandrels 57, 58 also are displaced by smaller distances. Thus, the pipe expanding tool 20 is made capable of expanding the end of the tube 100 to an inner diameter of ¼ of an inch, which is smaller than ⅜ of an inch.

In the foregoing manner, the adjustment screw 28 functions as an adjustment means for adjusting the angle of rotation β of the first and second levers 22, 23. By providing such an adjustment means, the angle of rotation β of the first and second levers 22, 23 can be adjusted beforehand to an angle corresponding to a desired inner diameter for the tube. Thus, with the pipe expanding tool 20 according to the embodiment of the present invention, it is unnecessary to prepare a plurality of different pipe expanding tools having different angles of rotation β for desired different inner diameters, and the tube 100 can be expanded to various desired inner diameters using a single pipe expanding tool.

Further, by providing the adjustment screw 28 on the side surface of the first lever 22, by a simple operation of rotating the adjustment screw 28, the angle of rotation β of the first and second levers 22, 23 can easily be set to an angle that corresponds to a desired inner diameter of the tube.

Furthermore, by providing the lock nut 29 for fixing rotation of the adjustment screw 28, the angle of rotation β of the first and second levers 22, 23 can reliably be set beforehand to an angle that corresponds to a desired inner diameter of the tube.

Still further, by providing the stopper 30 on the second lever 23, upon abutment of the adjustment screw 28 and the stopper 30, since rotation of the first and second levers 22, 23 is restricted, the first and second levers 22, 23 can be prevented from being rotated in excess of the preset angle of rotation β.

The mandrels 57, 58 are fixed detachably with respect to the jaws 26, 27 by the screws 63, 64. According to this structure, by removing the screws 63, 64 and then separating the mandrels 57, 58 from the jaws 26, 27, the mandrels 57, 58 can easily be replaced. Accordingly, prior to the pipe expansion process, the mandrels can be replaced by mandrels having suitable radii for the inner diameters of the tube, and there is no need to prepare a plurality of pipe-expanding tools equipped with mandrels of different radii for respective different inner diameters of the tubes prior to the pipe expansion process.

Further, by disposing the coil spring 43 between the first lever 22 and the second lever 23, upon displacement of the first lever 22 and the second lever 23, by means of the elastic force of the coil spring 43, the first lever 22 and the second lever 23 can easily be restored to their original positions. Accordingly, ease of operation of the pipe expanding tool can be improved.

In the top portions of the diameter expanding parts 59, 60 of the mandrels 57, 58, edge line portions thereof that correspond to the arcs of the semicircular shapes of the top surfaces of the top portions are formed in rounded corner shapes. Owing thereto, when the diameter expanding parts 59, 60 are inserted through the open end of the tube 100, catching or sticking of the top portions of the diameter expanding parts 59, 60 with respect to the inner wall of the tube 100 can be alleviated.

The mandrels 57, 58 are made up from the diameter expanding parts 59, 60, and the pair of ring-shaped base members 61, 62, which project in radial directions outwardly from the diameter expanding parts 59, 60. The diameter expanding parts 59, 60 and the base members 61, 62 are disposed in an integral manner. Consequently, after the diameter expanding parts 59, 60 have been inserted into the open end of the tube 100, the end of the tube 100 comes into abutment against the base members 61, 62, and the tube 100 can be prevented from coming into contact with the jaws 26, 27.

Moreover, with the pipe expanding tool 20 according to the above embodiment, a structure has been described in which the adjustment screw 28 and the lock nut 29 are disposed on the first lever 22, and the stopper 30 is disposed on the second lever 23. However, the present invention is not limited to this feature.

For example, an adjustment screw and a lock nut may be disposed on each of the seating section 31 of the first lever 22 and the seating section 32 of the second lever 23.

The elastic member is not limited to a coil spring 43, and for example, a plate spring or a spiral spring may be used as the elastic member.

The pipe expanding tool according to the present invention is not limited to the above embodiment. Various changes and modifications may be made to the embodiment without departing from the scope of the invention as set forth in the appended claims.

What is claimed is:

1. A pipe expanding tool comprising:

first and second levers rotatably connected to each other through a rotary shaft;

a pair of grips disposed on ends of the first and second levers;

a pair of jaws disposed on other ends of the first and second levers;

a pair of mandrels disposed on the pair of jaws, wherein the mandrels are capable of being inserted into an open end of a tube to be expanded;

a coil spring disposed between the first and the second levers; and an adjuster disposed on at least one of the first and second levers for adjusting an angle of rotation of the first and second levers, the adjuster including:

an adjustment screw disposed on a side surface of at least one of the first and second levers; and a stopper which disposed on a side surface of another of the first and second levers, wherein the coil spring is wound over an outer circumference of a shaft portion of the adjustment screw and a shaft portion of the stopper, and wherein rotation of the first and second levers is restricted by abutment of the adjustment screw against the stopper.

2. The pipe expanding tool according to claim 1, wherein the adjuster further comprises a lock nut for fixing rotation of the adjustment screw.

3. The pipe expanding tool according to claim 2, wherein the adjuster is disposed such that rotation of the first and second levers is restricted by abutment of the adjustment screw against the stopper.

4. The pipe expanding tool according to claim 1, wherein the mandrels are fixed detachably with respect to the jaws by a pair of screws.

* * * * *